US008171678B2

(12) United States Patent
Stanford et al.

(10) Patent No.: US 8,171,678 B2
(45) Date of Patent: May 8, 2012

(54) SLAB LIFT BRACKET

(75) Inventors: Frantz D. Stanford, Monona, WI (US); Thomas F. Mathews, Ft. Worth, TX (US); Winfred E. Mandody, Columbus, WI (US); Paul A. Hohensee, Germantown, WI (US)

(73) Assignee: Actuant Corporation, Butler, WI (US)

( * ) Notice: Subject to any disclaimer, the term of this patent is extended or adjusted under 35 U.S.C. 154(b) by 365 days.

(21) Appl. No.: 12/361,011

(22) Filed: Jan. 28, 2009

(65) Prior Publication Data

US 2010/0186313 A1 Jul. 29, 2010

(51) Int. Cl.
*E02D 35/00* (2006.01)

(52) U.S. Cl. ..... 52/125.5; 52/698; 52/707

(58) Field of Classification Search ..... 52/124.2, 52/125.1, 125.2, 125.3, 125.4, 125.5, 125.6, 52/126.1, 126.5, 126.6, 126.7, 127.2, 127.3, 52/127.5, 127.6, 127.7, 698, 699, 700, 704, 52/707, 741.15, 745.2, 745.21

See application file for complete search history.

(56) References Cited

U.S. PATENT DOCUMENTS

| | | | | |
|---|---|---|---|---|
| 2,277,449 | A | | 3/1942 | Paine |
| 2,686,420 | A | | 8/1954 | Youtz |
| 2,720,017 | A | | 10/1955 | Youtz |
| 2,863,313 | A | | 12/1958 | Youtz |
| 2,867,111 | A | | 1/1959 | Youtz |
| 2,871,544 | A | | 2/1959 | Youtz |
| 3,065,576 | A | | 11/1962 | Prizler et al. |
| 3,195,278 | A | | 7/1965 | Ballou |
| 3,216,171 | A | * | 11/1965 | Jenkins ..... 52/127.3 |
| 3,382,627 | A | | 5/1968 | Vartia |
| 3,404,503 | A | | 10/1968 | Courtois et al. |
| 3,420,014 | A | | 1/1969 | Courtois et al. |
| 3,530,675 | A | | 9/1970 | Turzillo |
| 3,705,469 | A | | 12/1972 | Eriksson |
| 3,712,014 | A | | 1/1973 | Waerner |
| 4,011,705 | A | | 3/1977 | Vanderklaauw |
| 4,017,115 | A | | 4/1977 | Holt et al. |
| 4,018,470 | A | | 4/1977 | Tye |
| 4,301,630 | A | | 11/1981 | Burkland |
| 4,325,575 | A | * | 4/1982 | Holt et al. ..... 294/89 |
| 4,702,045 | A | | 10/1987 | Fricker |
| 4,735,024 | A | | 4/1988 | Rosato et al. |
| 4,800,700 | A | | 1/1989 | May |
| 4,945,704 | A | | 8/1990 | Brown, Jr. |
| 5,269,630 | A | | 12/1993 | Bolin et al. |

(Continued)

FOREIGN PATENT DOCUMENTS

EP 0756049 B1 11/1999

(Continued)

OTHER PUBLICATIONS

Exhibit A—Drawing of slab lift bracket; admitted prior art.
Earth Contact Products—page from website http://www.earthcontactproducts.com/home/; admitted prior art.
ENERPAC—Hydraulic Power for all Industrial Applications catalog; p. 49; Copyright 2003, Actuant Corp.; admitted prior art.

*Primary Examiner* — Jessica Laux
(74) *Attorney, Agent, or Firm* — Quarles & Brady LLP

(57) ABSTRACT

The present invention provides a slab lift bracket that includes an collar portion with a center, an upper surface, a lower surface, an outer surface, and an inner surface. The slab lift bracket also includes a plurality of protruding members that are distributed around and fixed to the collar portion. The protruding members extend outwardly and downwardly of the collar portion at spaced apart locations, and have a hook shaped free end.

16 Claims, 14 Drawing Sheets

U.S. PATENT DOCUMENTS

| | | | |
|---|---|---|---|
| 5,460,499 | A | 10/1995 | Franklin |
| 6,193,442 | B1 | 2/2001 | May |
| 6,503,024 | B2 | 1/2003 | Rupiper |
| 6,539,685 | B2 | 4/2003 | Bell et al. |
| 6,814,524 | B1 | 11/2004 | Peterson |
| 6,840,714 | B1 | 1/2005 | Vache |
| 2007/0028557 | A1 | 2/2007 | Kelly et al. |
| 2009/0211178 | A1 * | 8/2009 | Marshall et al. ..... 52/126.6 |

FOREIGN PATENT DOCUMENTS

| | | | |
|---|---|---|---|
| EP | 1213410 | B1 | 3/2006 |
| WO | 2008/039225 | A2 | 4/2008 |

* cited by examiner

SLAB LIFT BRACKET

CROSS-REFERENCE TO RELATED APPLICATION

Not applicable.

STATEMENT CONCERNING FEDERALLY SPONSORED RESEARCH OR DEVELOPMENT

Not applicable.

FIELD OF THE INVENTION

The invention relates to a bracket embedded in a concrete slab for lifting the concrete slab, the concrete slab typically being the foundation of a building.

BACKGROUND OF THE INVENTION

Brackets that are embedded into a concrete slab, such as the foundation of a building, are well known in the art. Such lift brackets are typically used with a lifting mechanism to lift a foundation above the ground on which the foundation was formed. A foundation may need to be lifted above the ground due to instability of the ground. Such instability may cause cracks to form or otherwise weaken the foundation. Once the foundation is lifted, it is fixed to piers embedded in the ground that support the foundation for the life of the foundation. The foundation may be supported above the ground by only a few inches, one to two feet or more, and may be supported a full floor or more above the ground, for example if the building is elevated or the slab is an upper floor or roof.

In some cases, a lift bracket may be installed for use with a damaged existing foundation to lift it. In this situation, a hole may be cut into the foundation wherein a bracket is installed, permitting the foundation to be lifted by the bracket to effect repairs.

In other cases, lift brackets are embedded in the foundation when it is first formed. The foundation is then lifted above the ground when the foundation has sufficiently cured. This prevents unstable ground from causing subsequent damage to the foundation.

However, lift brackets and lift mechanisms have several disadvantages. Specifically, most lift brackets are relatively expensive. In addition, the load carrying capacity of most lift brackets is relative low. Therefore, many lift brackets are needed to lift a foundation, further increasing the costs of a such a process. Further still, several components remain embedded in the foundation after the lifting process. The remaining components may be visible and are not usually considered aesthetically pleasing. Even further still, some designs require access to the space beneath the foundation to secure the foundation after the lifting process. This can be difficult depending on the distance the foundation is raised.

Considering the above limitations, a need exists for an improved slab lift bracket.

SUMMARY OF THE INVENTION

The present invention provides a slab lift bracket that includes a collar portion having a center, a longitudinal axis at the center, an upper surface, a lower surface, an outer surface that faces away from the center of the collar portion, and an inner surface that faces toward the center of the collar portion. A plurality of protruding members are distributed around the collar portion and are spaced apart from one another. The protruding members extend outwardly and downwardly from the collar portion to be embedded in the concrete slab poured around the bracket.

In another aspect of the invention, each protruding member may have a first arcuate section adjacent to the end section. In addition, each protruding member may have a linear section adjacent to the first arcuate section angled downward relative to the end section. Further still, each protruding member may have a second arcuate section adjacent to the linear section that terminates at a free end in a hook-like structure.

The foregoing and other objects and advantages of the invention will appear in the detailed description that follows. In the description, reference is made to the accompanying drawings that illustrate a preferred embodiment of the invention.

DETAILED DESCRIPTION OF THE INVENTION

Figure 1:
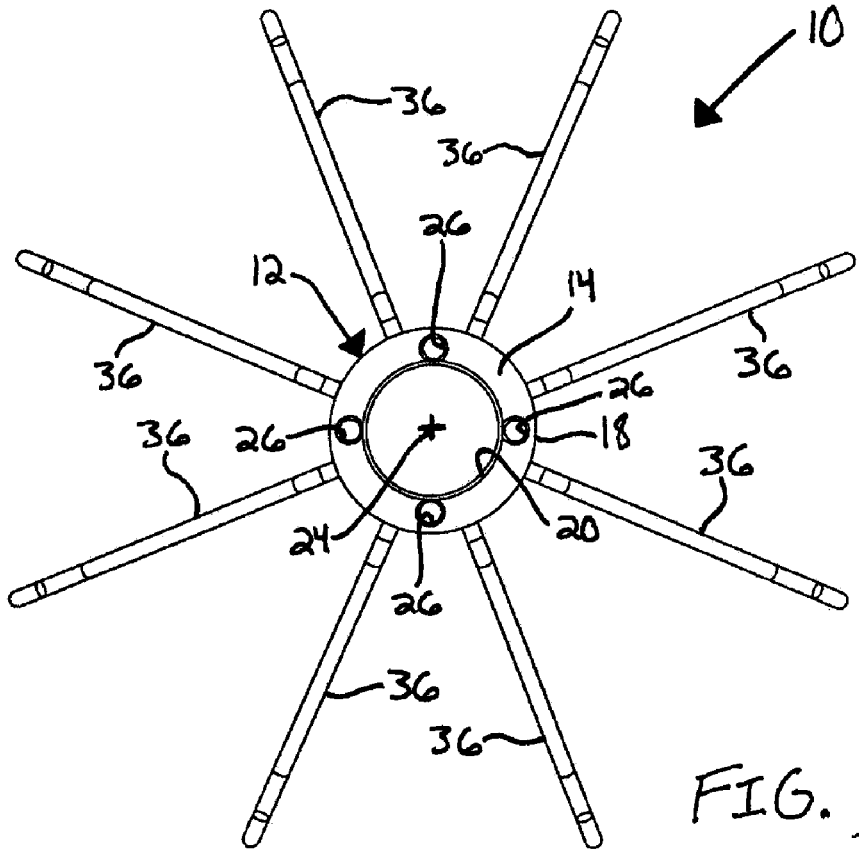
FIG. 1 is a top view of a slab lift bracket of the present invention.

Referring to FIGS. 1-4, a slab lift bracket 10 of the present invention includes a collar portion 12. The collar portion 12, which is annular as illustrated, includes an upper surface 14, a lower surface 16, an outer surface 18, and an inner surface 20. The upper surface 14 and the lower surface 16 are substantially flat and perpendicular to the longitudinal axis 22 defined by the center 24 of the collar portion 12. The outer surface 18 faces radially away from the center 24 of the collar portion 12. The inner surface 20 faces radially towards the center 24 of the collar portion 12 and encircles a hollow interior section of the collar portion 12.

The upper surface 14 includes a plurality of holes 26. There are preferably four holes 26 on the upper surface 14 that are spaced 900 apart from each other. The holes 26 on the upper surface 14 are preferably threaded to accommodate threaded fasteners, such as threaded rods or bolts. This aspect of the invention will be discussed in further detail below. The outer surface 18 preferably includes a shoulder section 28 that provides the outer surface 18 with two different diameters. The shoulder section 28 is included so the slab lift bracket 10 may be positioned on a tube before a slab is formed around the slab lift bracket 10. This aspect of the invention will be discussed in further detail below.

The collar portion 12 preferably includes several tapered surfaces. Specifically, a tapered surface 30 is preferably included between the upper surface 14 and the inner surface 20. Another tapered surface 32 is preferably included between the lower surface 16 and the inner surface 20. Yet another tapered surface 34 is preferably included between the lower surface 16 and the outer surface 18.

The collar portion 12 is preferably made from a section of seamless tube stock, such as a section of ASTM 1026 steel. Typical dimensions for the collar portion 12 are as follows: an overall height of 2" between the upper surface 14 and the lower surface 16; a diameter of 6.25" for the outer surface 18; a diameter of 4" for the inner surface 20; and the centers of the holes 26 positioned on a bolt circle with a diameter of 5". These dimensions may be modified according to the load requirements of the slab lift bracket 10.

Figure 2:
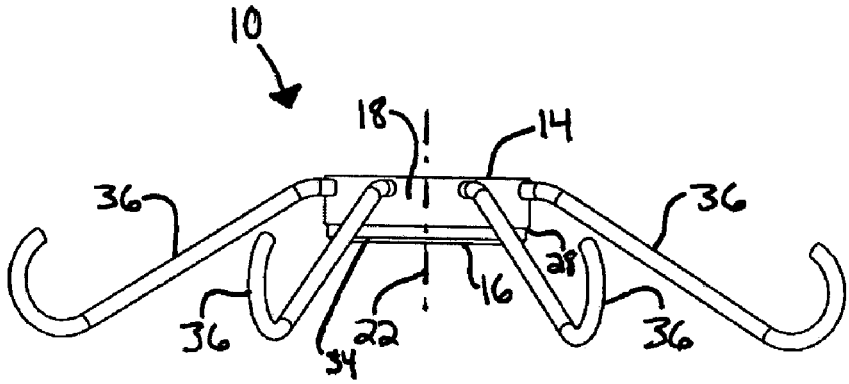
FIG. 2 is a front view of the slab lift bracket of FIG. 1.
Figure 3:
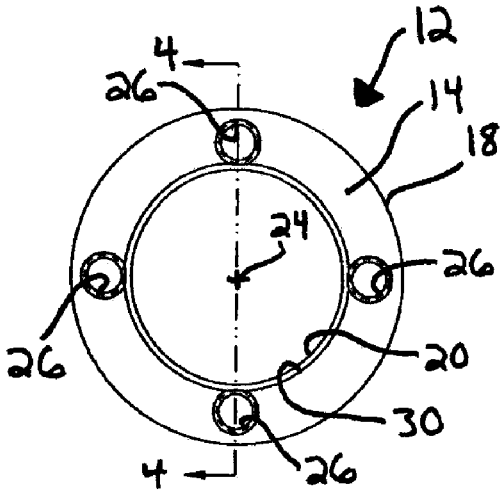
FIG. 3 is a top view of an annular collar portion of the slab lift bracket of FIG. 1.
Figure 4:
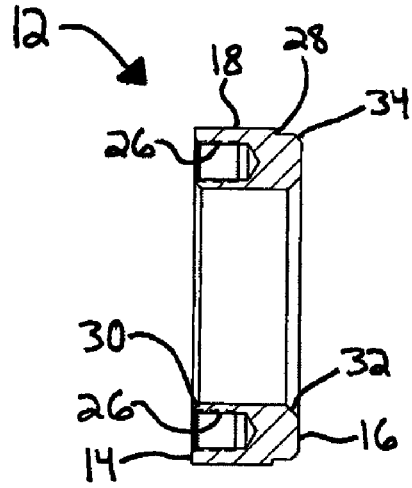
FIG. 4 is a sectional view along the line 4-4 of FIG. 3.
Figure 5:
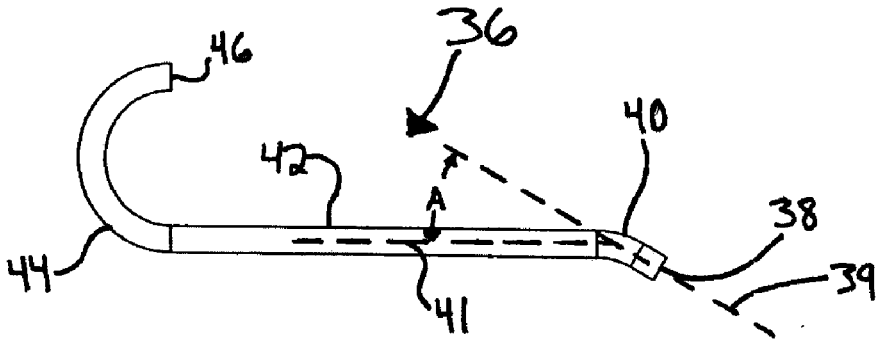
FIG. 5 is a side view of an embedded protruding member of the slab lift bracket of FIG. 1.

Referring to FIGS. 1 and 2, the slab lift bracket 10 includes a plurality of spoke-like protruding members 36 which are embedded in the slab after it is poured around the bracket 10. The protruding members 36 protrude from the collar portion 12 and are distributed around the collar portion 12 and spaced apart from one another. The protruding members 36 preferably terminate at the outer surface 18 of the collar portion 12. This may be achieved by welding an end section 38 (FIG. 5) of each protruding member 36 to the outer surface 18 using a process such as upset welding or stud welding. These welding processes are well known in the art. Alternatively, each protruding member 36 may include a threaded section (not shown) adjacent to the end section 38 that attaches to a threaded hole (not shown) in the outer surface 18 of the collar portion 12, or may be not threaded and received in unthreaded holes in the outer surface 18 of the collar portion 12. In any case, each protruding member 36 is preferably positioned such that the longitudinal axis 39 of the end section 38 extends in a direction radially away from the center 24 of the collar portion 12.

Each protruding member 36 extends radially outward from the collar portion 12 and extends axially downward thereof. Each protruding member 36 includes a first arcuate section 40 adjacent to the end section 38. The first arcuate section 40 is preferably shaped such that the longitudinal axis 41 of an adjacent linear section 42 is offset from the longitudinal axis 39 of the end section 38 by an angle A. The angle A is preferably 45° to prevent the slab lift bracket 10 from punching out of a slab when the bracket 10 is embedded therein. However, the angle A may be reduced to limit the overall height of the slab lift bracket 10. This may be desirable when a slab is relatively thin. Accordingly, the angle A is preferably 30° in this situation.

Each protruding member 36 also includes a second arcuate section 44 adjacent to the linear section 42. The second arcuate section 44 is preferably a half circle with a free end 46 terminating at a location higher than the point where the second arcuate section 44 meets the linear section 42. The second arcuate section 44 does not need to be a complete half circle, as this will provide material and cost savings. However, a half circle is preferred since this provides increased resistance to pull out and punch out when the slab lift bracket is embedded in a slab. Each protruding member 36 is preferably made from steel rod stock with a diameter of 0.5". As such, materials used to make rebar, such as Nelson® stud D2β deformed bar anchors, are appropriate. Appropriate dimensions for the sections of each protruding member 36 are as follows: the end section 38 has an overall height of 0.5"; the first arcuate section 40 has a radius of 1.5"; the linear section 42 has a length of 8"; and the second arcuate section 44 has a radius of 1.5". Like the dimensions of the annular section 12, these dimensions may be modified according the load requirements of the slab lift bracket 10.

It can be appreciated that the slab lift bracket 10 is relatively large compared to prior art designs considering the dimensions listed above. In fact, the dimension from end to end of diametrically opposite protruding members 36 is greater than 22". Those skilled in the art will therefore recognize that a large portion of the slab (greater than 22" in diameter) must fail in shear before the slab lift bracket will punch out of the slab. As such, the load carrying capacity of the slab lift bracket may be, for example, 40,000 lbs.

The slab lift bracket 10 of the present invention is preferably created as follows: first, a length of seamless tube is cut according to the distance between the upper surface 14 and the lower surface 16. This generally forms the shape of the collar portion 12. Next, the cut seamless tube is machined to form the tapered surfaces 30, 32, and 34 and the shoulder section 28. Any appropriate machining process may be used for this step, such as turning on a lathe. Holes and threads are next cut into the outer surface 18 if the annular section 12 is to be threadably connected to the protruding members 36. If the protruding members 36 are welded to the collar portion 12, this step is skipped. Next, a section of straight rod stock is cut to the proper length for use in forming the protruding members 36. If the dimensions listed previously for the sections of the protruding members 36 are used, a proper length for the cut rod stock is approximately 14". Threads are next formed on an end of the cut rod stock if the annular section 12 is to be threadably connected to the protruding members 36 or if welded these threads are not formed. The cut sections of rod stock are next welded, or alternatively, threadably connected to the collar portion 12. Welding of each section of rod stock preferably occurs simultaneously if the cut sections of rod stock are welded to the collar portion 12. Finally, the cut section of rod stock is bent to form the protruding members 36. The cut sections of rod stock are preferably bent simultaneously, but could be bent individually either before or after attachment to the collar portion 12.

Figure 6:
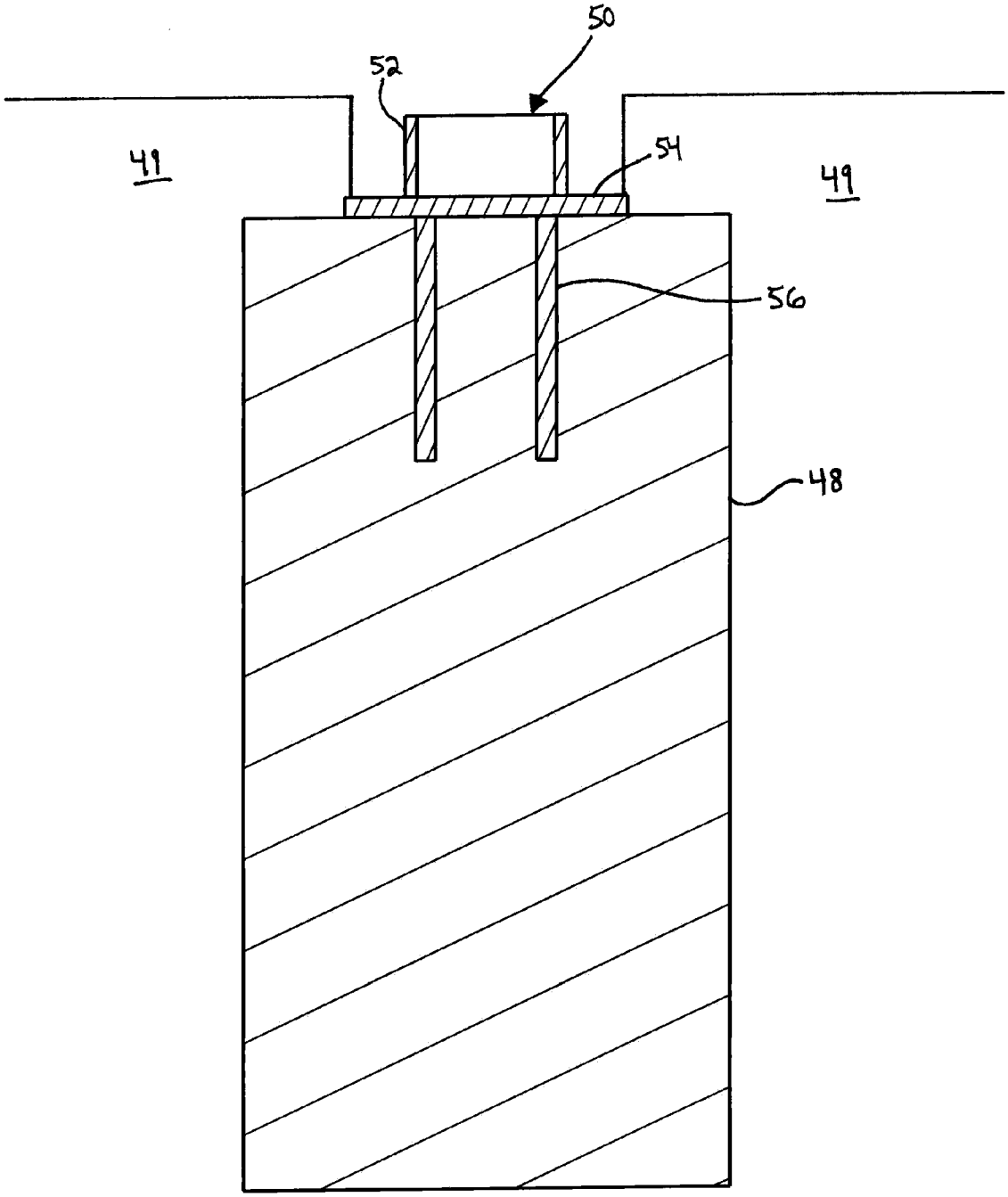
FIG. 6 is a sectional view of a pier and a pier cap positioned in the ground.

The process for embedding the slab lift bracket 10 in a slab and lifting the slab thereafter is as follows: referring to FIG. 6, a pier 48, typically poured concrete, is cast into the ground 49 below where the slab is to be located. The hole for the pier 48 may be formed using any method known in the art, such as using an auger. The pier 48 is generally cylindrical and may extend 10' to 15' into the soil depending on soil conditions. A pier cap 50 is embedded in the top surface of the pier 48. The pier cap 50 includes an annular section 52, a plate section 54, and embedded sections 56. The pier cap 50 is preferably metal.

Figure 7:
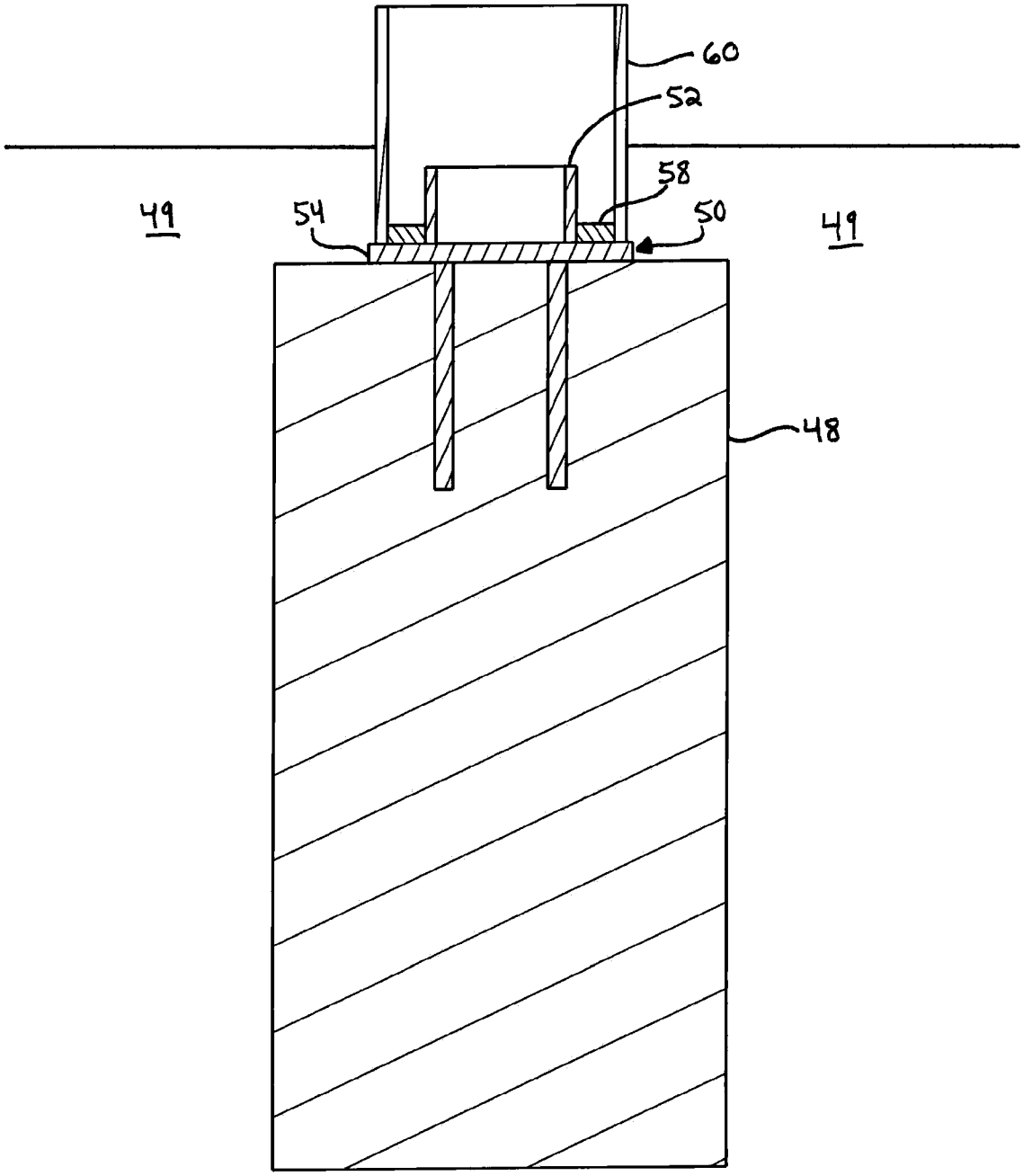
FIG. 7 is a sectional view of a tube and annular plate in addition to the components of FIG. 6.

Referring to FIG. 7, an annular plate 58 is next placed around the annular section 52 of the pier cap 50, and a tube 60 is placed around the annular plate 58. The annular section 52, the annular plate 58, and the tube 60 are preferably designed in a close fitting manner. As such, the annular plate 58 prevents the tube 60 from moving significantly on the surface of the plate section 54 of the pier cap 50. The purpose of the tube 60 will be explained in the following steps. An appropriate height for the tube is 5.75", although this dimension may be modified. The tube 60 is preferably made of a plastic, such as polyvinyl chloride (PVC), and the annular plate 58 is preferably made from an inexpensive plastic, such as nylon or polyethylene.

Figure 8:
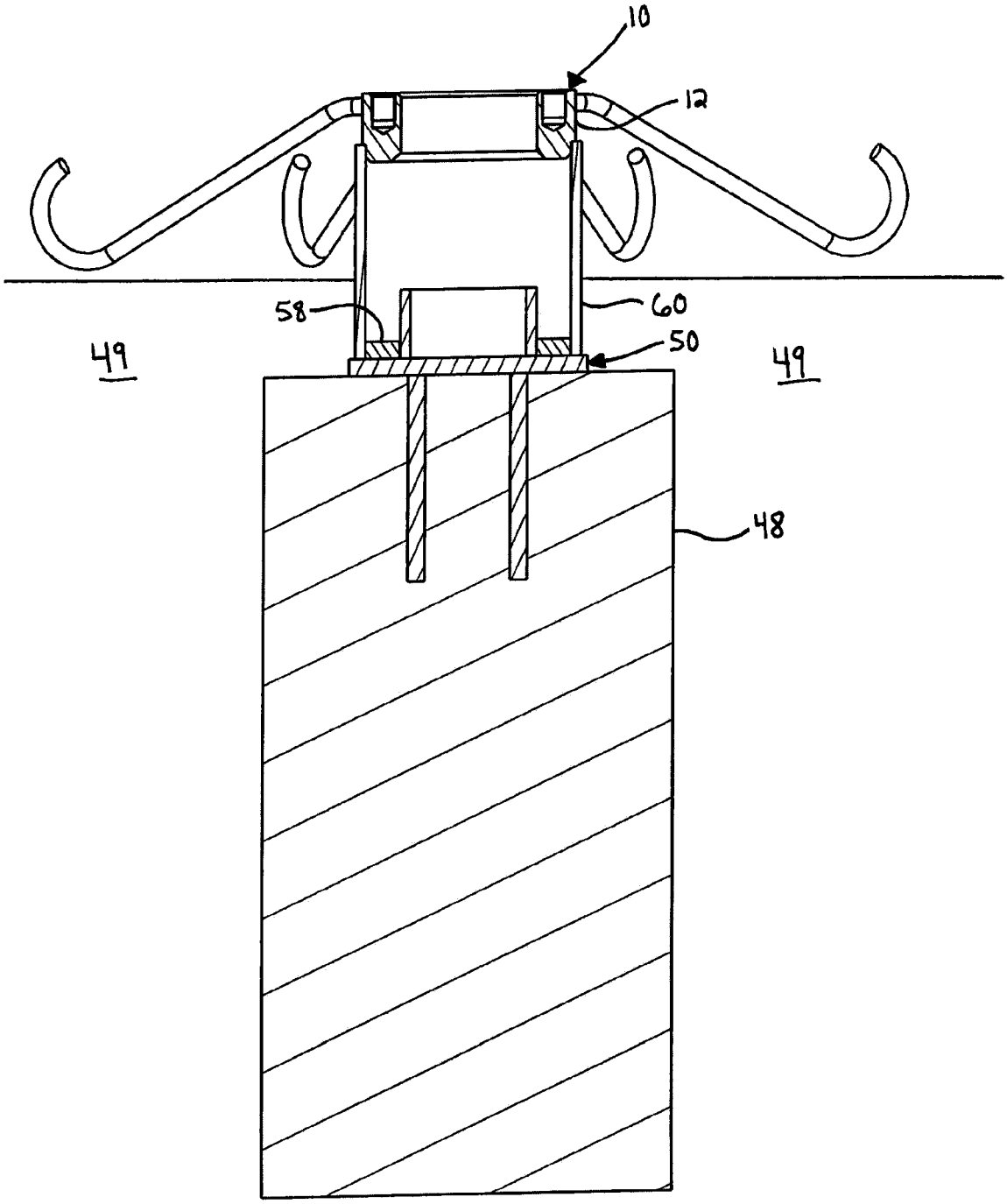
FIG. 8 is a sectional view of the slab lift bracket of FIG. 1 in addition to the components of FIG. 7.
Figure 17:
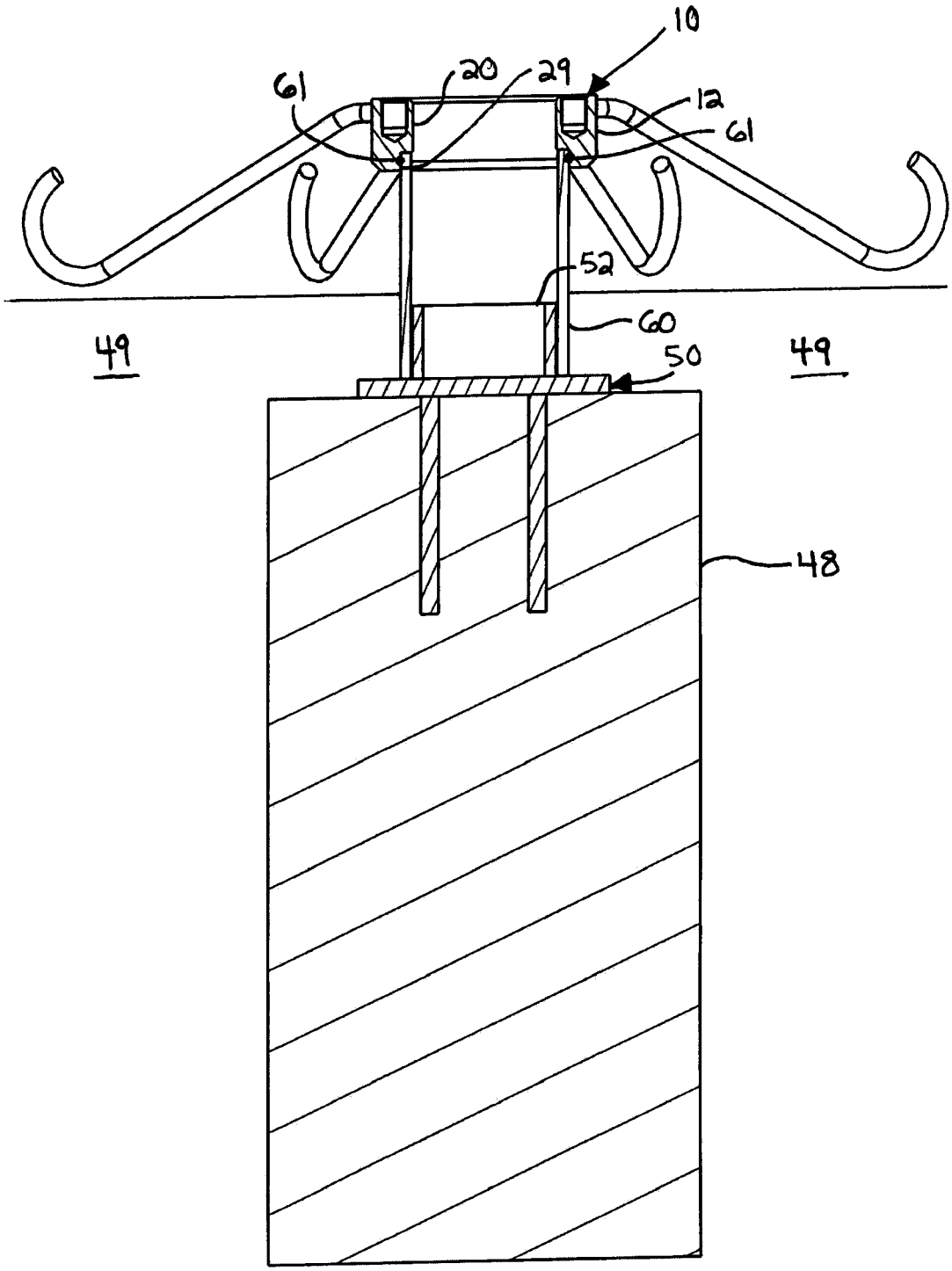
FIG. 17 is a view like FIG. 8 of an alternate embodiment.

Referring to FIG. 8, the slab lift bracket 10 of the present invention is placed on top and partially inside the tube 60. It should be noted that the slab lift bracket 10 enters the tube 60 up to the shoulder section 28 on the outer surface 18. Alternatively, the diameter of the tube 60 may be reduced such that the tube 60 enters the hollow interior portion of the collar portion 12 and supports the slab lift bracket 10, as shown in FIG. 17. The annular plate 58 and the shoulder section 28 on the outer surface 18 of the slab lift bracket 10 are removed for this alternative. The tube 60 is placed around the annular section 52 of the pier cap 50. In addition, a shoulder section 29 is formed on the inner surface 20 of the slab lift bracket 10 and an o-ring 61 is provided in a groove at the interface between the shoulder section 29 and the tube 60 to frictionally secure the assembly.

Figure 9:
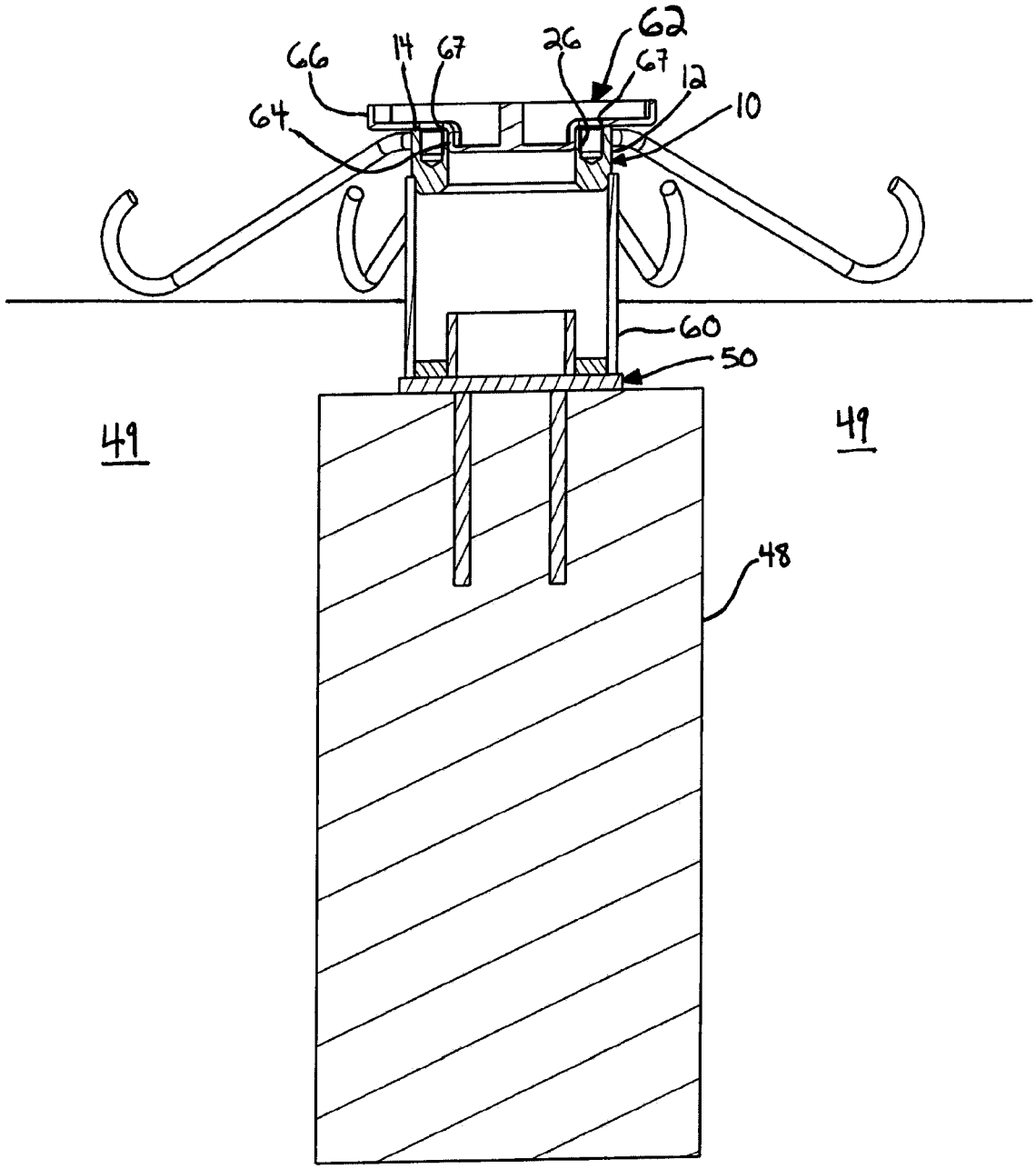
FIG. 9 is a sectional view of a leaveout in addition the components of FIG. 8.

Referring to FIG. 9, a temporary bracket cap, or leaveout 62, is next inserted on top and partially inside the slab lift bracket 10. The leaveout 62 includes a lower section 64 located inside the hollow interior section of the collar portion 12 of the slab lift bracket 10. The leaveout 62 also includes an upper section 66 located on top of the collar portion 12 of the slab lift bracket 10. The upper section 66 of the leaveout 62 is larger in diameter than the lower section 64 to cover the upper surface 14 of the collar portion 12. An appropriate height of the upper section 66 of the leaveout 62 is 0.75", although this dimension may be modified. The leaveout 62 also includes holes 67 to permit fasteners (not shown) to pass there through and into the holes 26 on the collar portion 12 of the slab lift bracket 10, thereby fixing the leaveout 62 to the slab lift bracket 10. The leaveout 62 is preferably made of a plastic.

Figure 10:
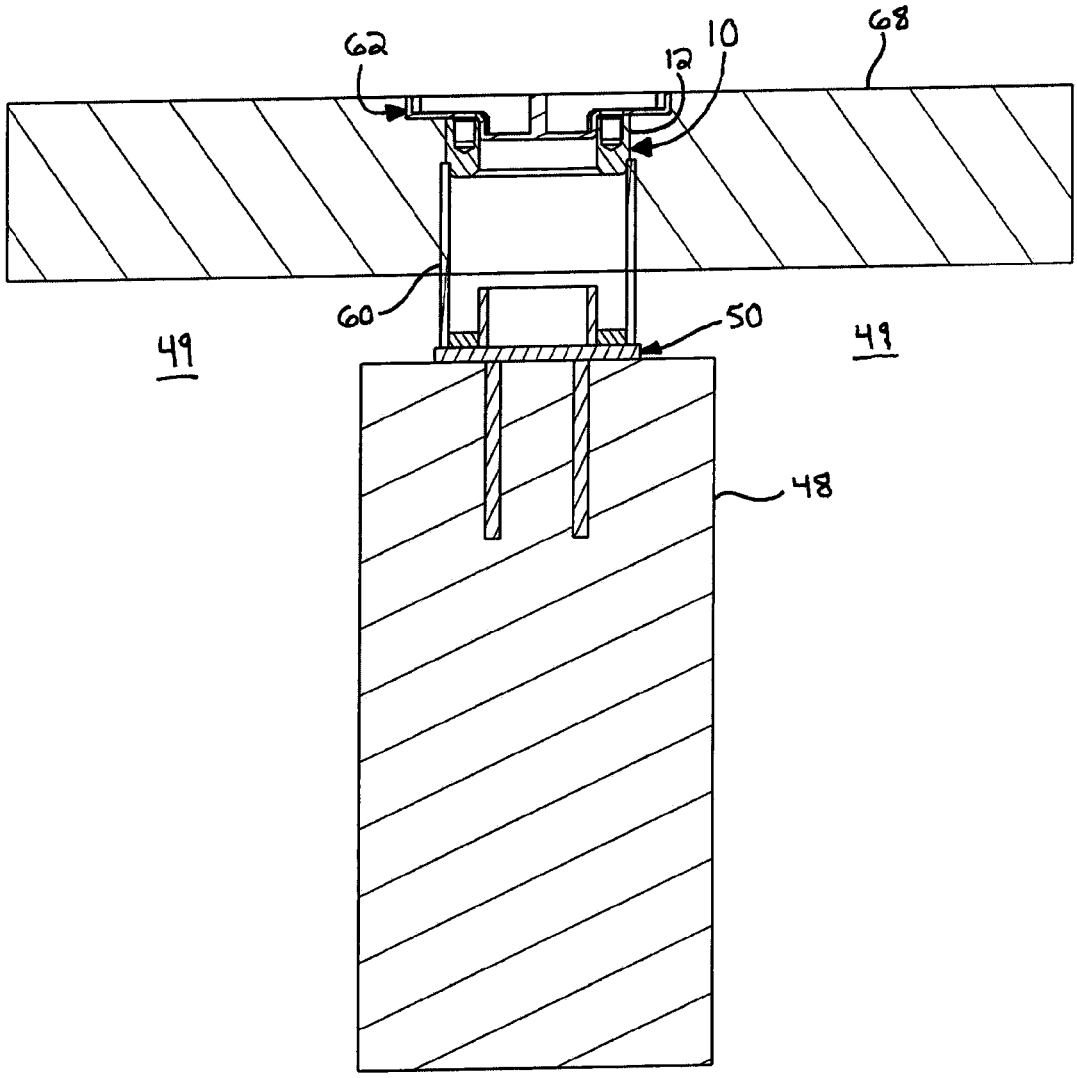
FIG. 10 is a sectional view of a concrete slab cast around the components of FIG. 9.

Referring to FIG. 10, concrete 68 is next poured above the ground 49 and around the slab lift bracket 10, tube 60, and leaveout 62, to thereby embed the protruding members 36 in the concrete 68. The concrete 68 may be poured in any manner known in the art. In addition, the concrete 68 may include pre-stressed reinforcements (not shown) that are also well known in the art, laid prior to pouring the concrete and tensioned after the concrete partially cures. A sufficient amount of concrete 68 is preferably poured such that the top surface of the concrete 68 is level with the top edge of the leaveout 62. If the dimensions listed previously for the slab lift bracket 10 components are used, an appropriate thickness for the concrete is 6", although this dimension may be modified. The concrete 68 is preferably allowed to sufficiently cure to form a concrete slab 68' before proceeding to the next step.

It should now be appreciated that leaveout 62 and the tube 60 prevent concrete from entering the space below the collar portion 12 of the slab lift bracket 10 and above the pier cap 50. The seals between the components that envelope the space inside the tube 60 are sufficient to keep concrete out of that space, and a removeable cover may be provided over the leaveout 62 to prevent concrete from entering the top of the leaveout 62 when the concrete slab is leveled or screeded. Maintaining a hollow space inside the tube 60 is important for other components used later in the process. This aspect will be discussed in further detail below.

Figure 11:
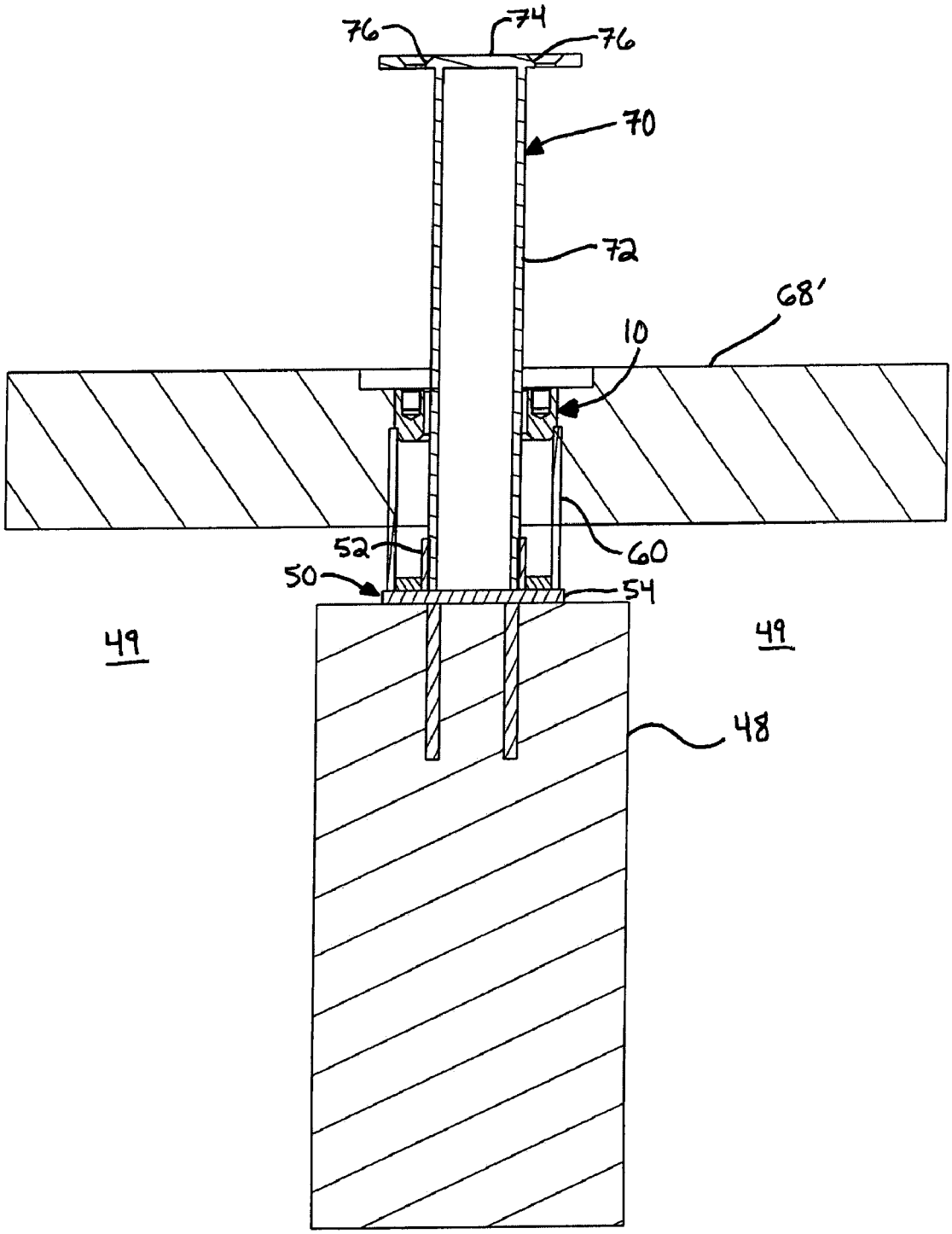
FIG. 11 is a sectional view of a support column positioned inside the slab lift bracket, the tube, and the pier cap of FIG. 10.

Referring to FIG. 11, after the concrete slab 68' has formed, the leaveout 62 is removed. A support column 70 is then inserted into the hollow space formed by the leaveout 62 and the tube 60. The support column 70 includes a lower section 72 and an upper plate section 74. The lower section 72 of the support column 70 is preferably a tall and hollow steel section. An appropriate height for the lower section 72 is 19.25", although this dimension may be modified based on the distance the concrete slab 68' is to be raised. The lower section 72 of the support column 70 enters the annular section 52 of the pier cap 50 and is supported by the plate section 54 of the pier cap 50. Alternatively, shims (not shown) may be placed between the lower section 72 of the support column 70 and the plate section 54 of the pier cap 50 to adjust the position of the support column 70. The annular section 52 of the pier cap 50 and the lower section 72 of the support column 70 are preferably designed in a close fitting manner. The upper plate section 74 is a thin and generally flat steel section located above the lower section 72 of the support column 70. The upper plate section 74 includes through holes 76 that are preferably countersunk to receive flat head screws. The purpose of the upper plate section 74 and the through holes 76 thereon will be explained in the next step.

Figure 12:
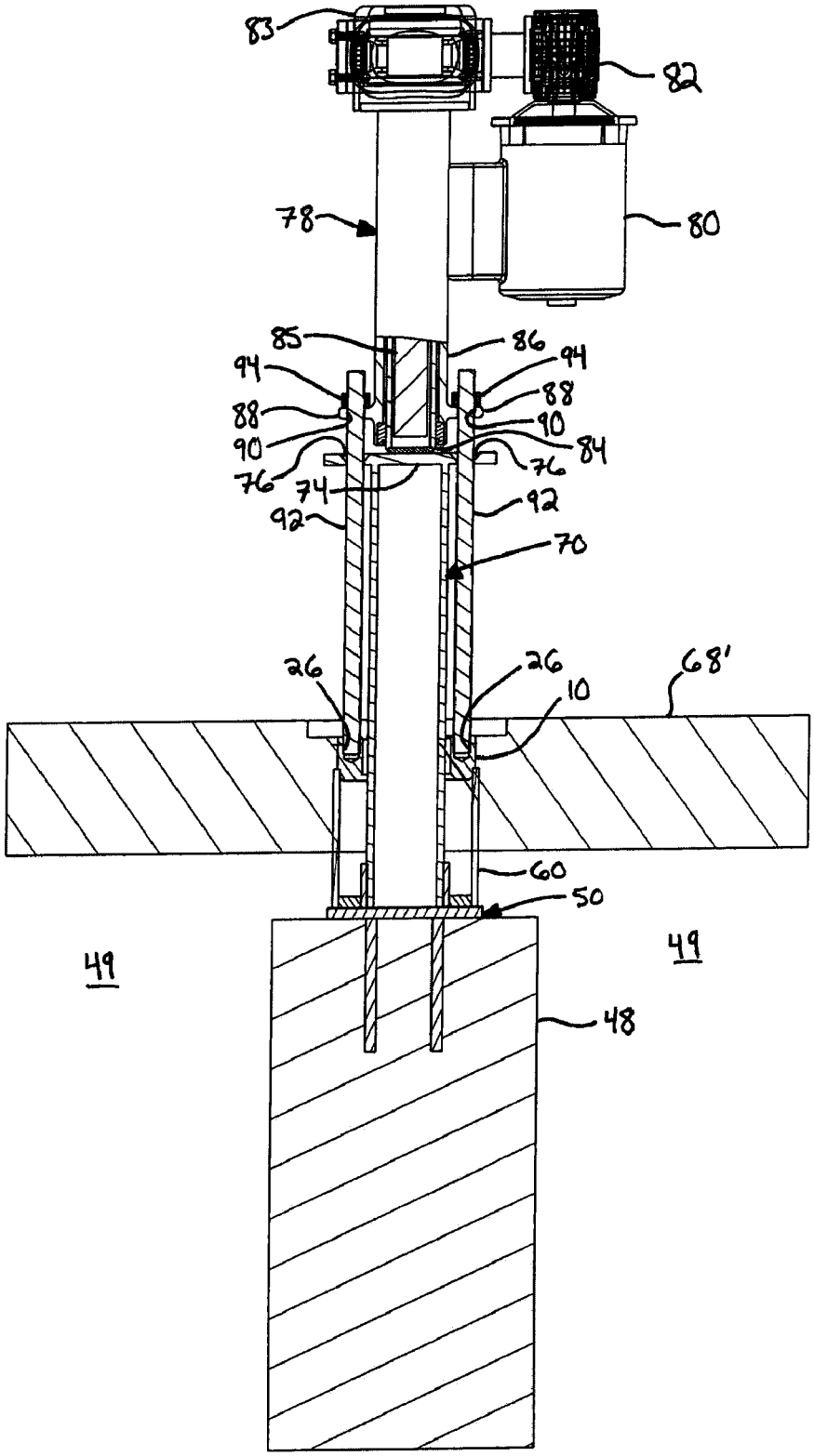
FIG. 12 is a partial sectional view of a lifting mechanism in addition to the components of FIG. 11.

Referring to FIG. 12, a lifting device such as a screw jack assembly 78 is next positioned above the concrete 68 and the slab lift bracket 10. The screw jack assembly 78 preferably includes an induction drive motor 80 and speed reducers 82 and 83. If speed reducers 82 and 83 are included, the overall reduction ratio is preferably between 50:1 and 100:1. Alternatively, one of the speed reducers 82 and 83 may be used to change the direction of motion and not to reduce speed. The screw jack assembly 78 includes an extending nut section 84 that translates relative to the other components of the screw jack assembly 78. The extending nut section 84 is driven by a screw section 85 that rotates relative to the other components of the screw jack assembly 78. The screw jack assembly 78 also includes an outer sleeve section 86 that encloses the extending nut section 84 when the extending nut section 84 is retracted. The outer sleeve section 86 includes a plurality of flanges 88 with through holes 90. Alternatively, the outer sleeve section 86 may include a single continuous flange with a plurality of through holes. Each through hole 90 accommodates a rod section 92 that is connected to a nut 94 on the upper surface of one of the flanges 88. Each rod section 92 passes through one of the through holes 76 on the upper plate section 74 of the support column 70. Each rod section 92 also threadably connects to one of the holes 26 of the slab lift bracket 10. There are preferably the same number of rod sections 92 and nuts 94 as there are holes 26 in the slab lift bracket 10. The rod sections 92 are preferably smooth members except for threads on each end to connect to the holes 26 of the slab lift bracket 10 and the nuts 94.

Although a screw jack assembly 78 is preferred for lifting the concrete slab 68' and the slab lift bracket 10, other types of devices known in the art may be used. For example, a hydraulic actuator may be used of the type typically used in stage-lift applications, in which a cylinder sitting on top of plate 74 would push up on a plate through which the rods 92 extend to lift the slab. When the cylinder reaches the end of its stroke, nuts on the rods are tightened against the top of the plate 74 to hold the slab in position while the cylinder is retracted and cribbing is added between the cylinder and the upper plate to do another lifting cycle.

Figure 13:
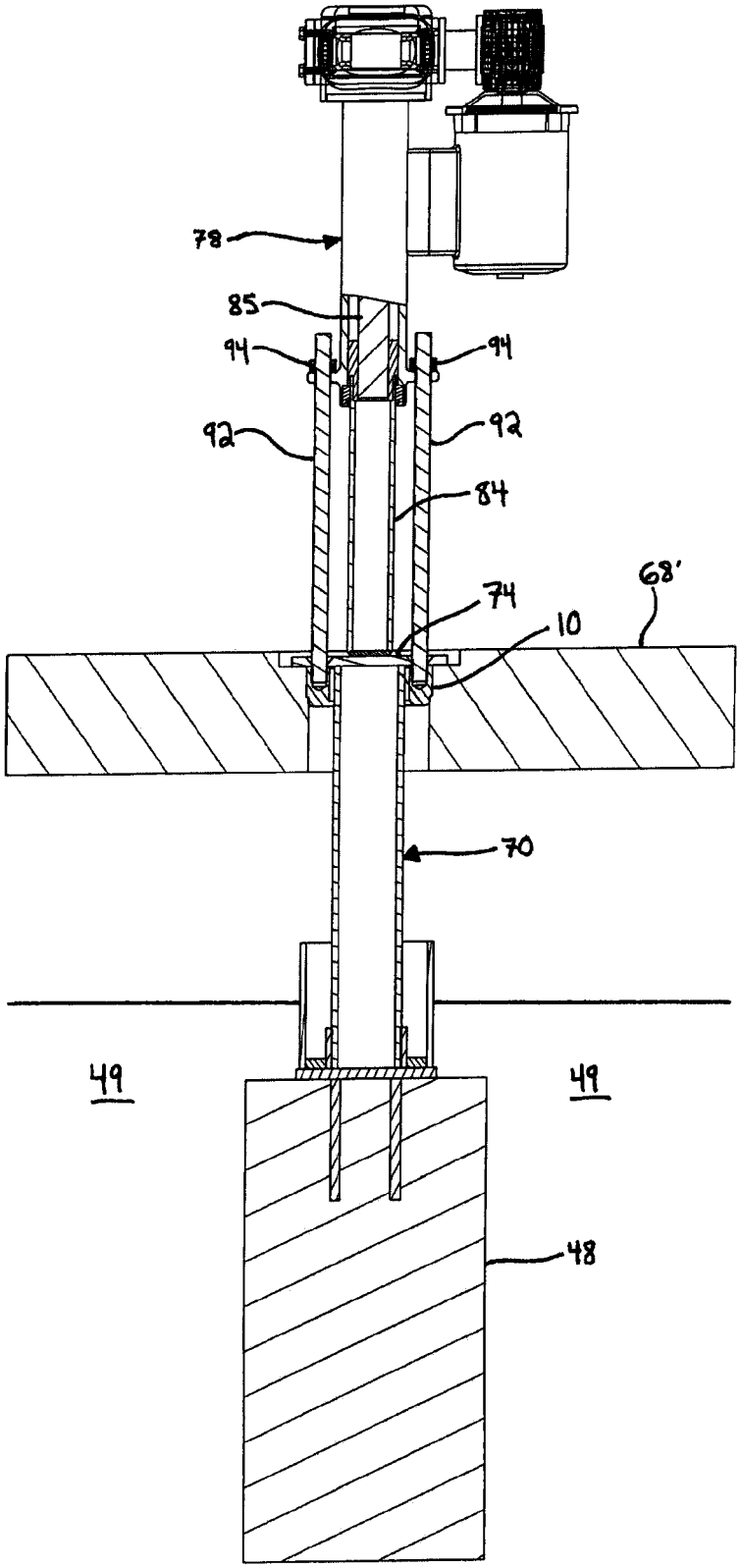
FIG. 13 is a partial sectional view of the components of FIG. 12 with the concrete slab in a lifted position.

Referring to FIG. 13, the extending section 84 is extended and abuts against the upper plate section 74 of the support column 70. The other components of the screw jack assembly 78 are forced to move upward since the support column 70 is supported by the pier 48 and therefore by the ground 49. The slab lift bracket 10 and the concrete slab 68' are also forced to move upward due to their connection with the rod sections 92 and the screw jack assembly 78. It should be understood that the maximum distance the concrete slab 68' may be lifted is determined by the height of the support column 70. That is, the upper plate section 74 of the support column 70 limits the distance the concrete slab 68' may be raised, as shown in FIG.

13. The concrete slab 68' may be lifted a maximum distance of about 12" if the dimensions discussed previously are used.

Alternatively, the screw jack assembly 78 may be replaced by a simple hydraulic system. This hydraulic system may include a hydraulic cylinder and a manual or powered pump at each lift point. If a hydraulic system is provided at multiple lift points, each lift point may be raised some small amount, e.g., ¼", at a time, so that the difference in height between lift points stays small as the slab is being lifted. This is repeated until all lift points are completely raised to the full lift level.

Figure 14:
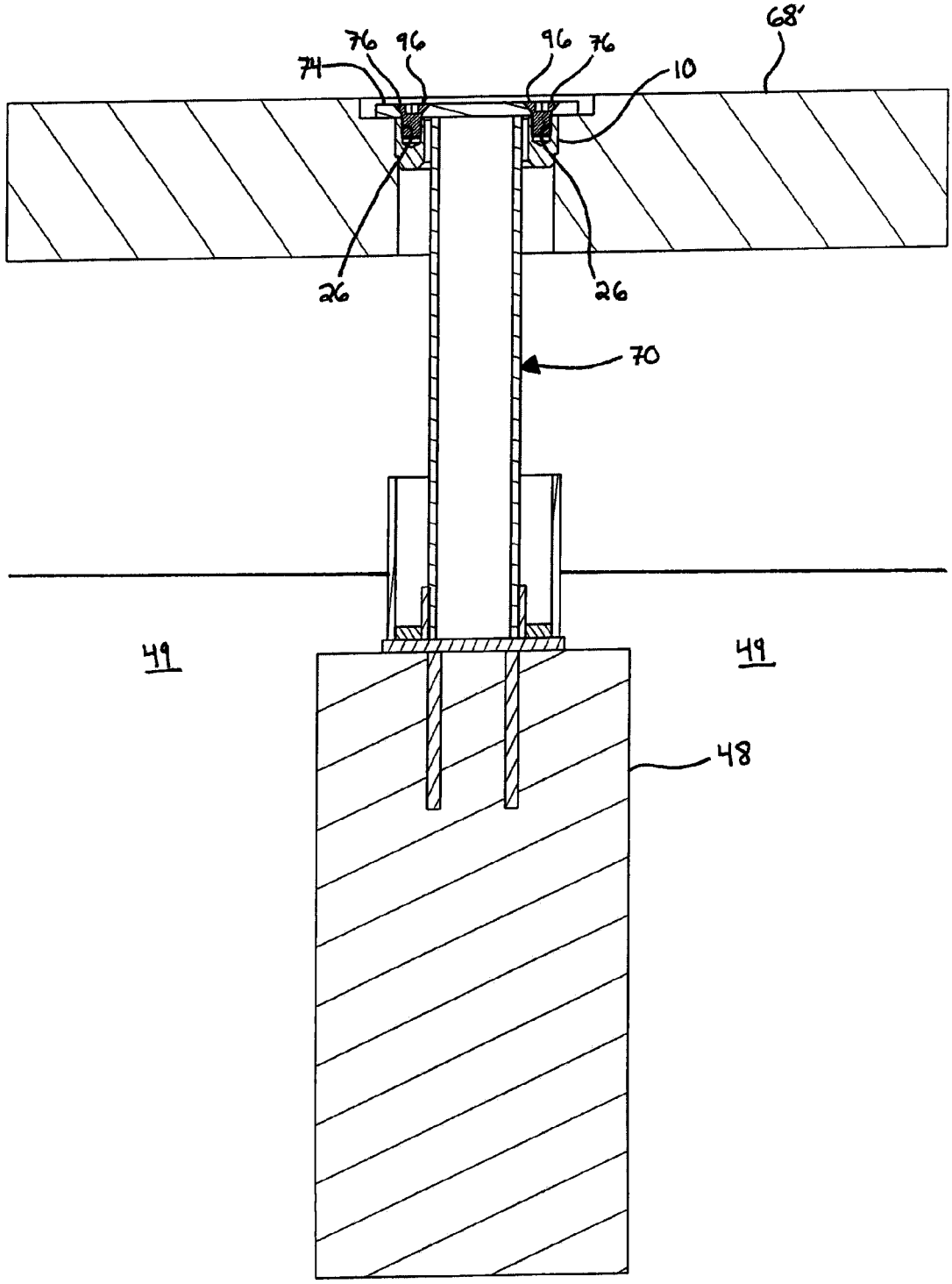
FIG. 14 is a sectional view with the lifting mechanism of FIG. 13 replaced by fasteners.

Referring to FIG. 14, the screw jack assembly 78 and the rod sections 92 are removed from above the concrete slab 68' and the slab lift bracket 10 after the concrete slab 68' has been lifted. A single rod section 92 is removed at a time and is immediately replaced by a bolt 96 so that the concrete slab 68' does not fall and the load is transferred from the rods 92 to the bolts 96. Each bolt 96 is inserted through one of the holes 76 in the upper plate section 74 and is screwed into one of the holes 26 in the slab lift bracket 10. The slab lift bracket 10 and the concrete slab 68' are thereby fixed to and supported by the support column 70 and the ground 49. The bolt 96 is preferably a flathead screw.

Figure 15:
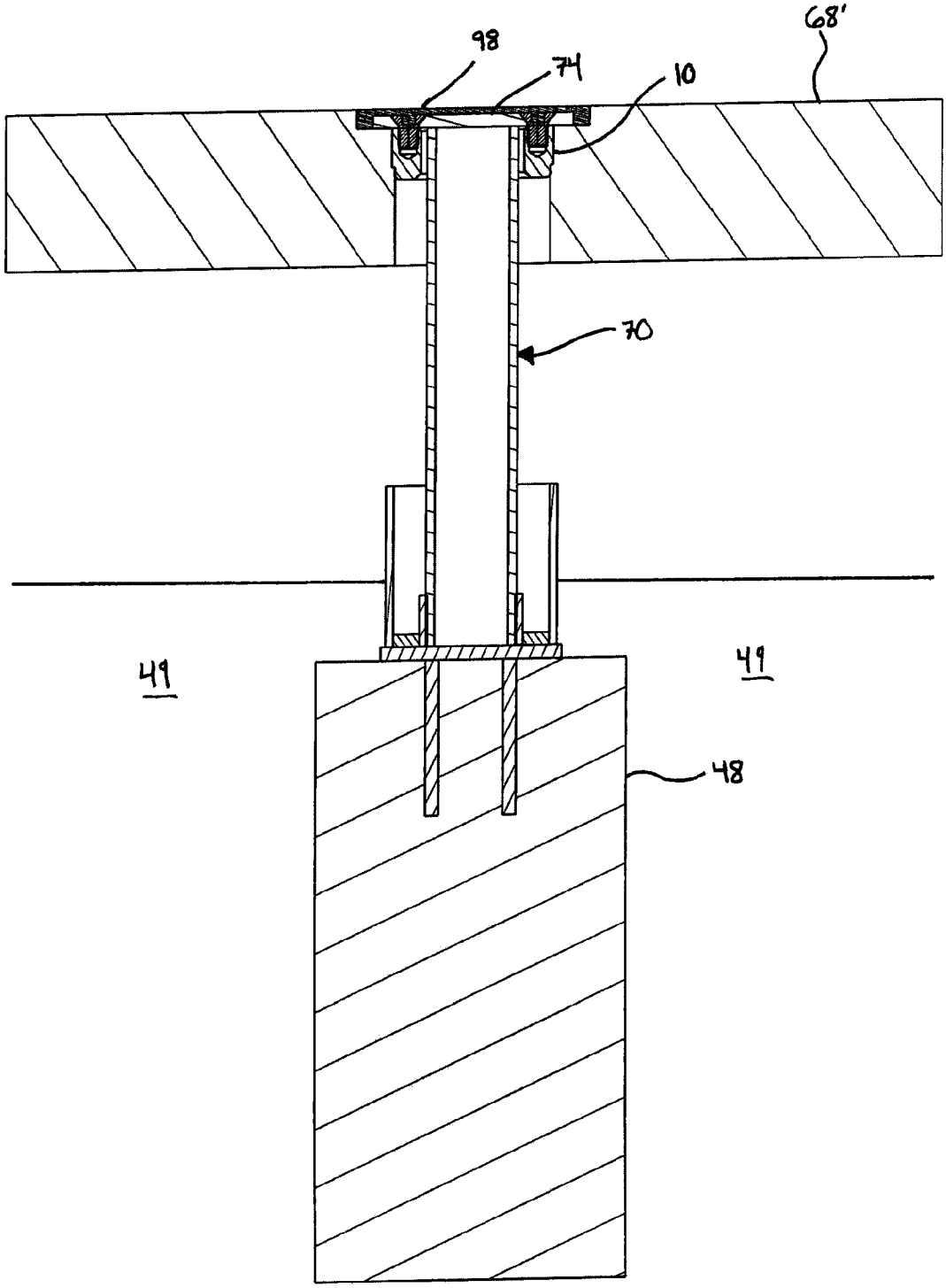
FIG. 15 is a sectional view with concrete concealing the fasteners of FIG. 14.

Referring to FIG. 15, concrete 98 is next poured in the space above the upper plate section 74 within the concrete slab 68'. The concrete 98 is preferably poured such that the top surface is even with the top surface of the concrete slab 68' and the upper plate section 74 is completely concealed. The process for lifting the concrete slab 68' is complete when the concrete 98 cures.

Those skilled in the art will appreciate that a single slab lift bracket and lifting device are typically not sufficient to raise a slab. Instead, multiple sets of slab lift brackets and lifting devices are typically used to raise a slab. For example, 30 sets of these components may be used to lift the foundation of a building. Preferably each slab lift bracket is required to support at most 16,000 lbs. if the dimensions discussed previously are used.

Figure 16:
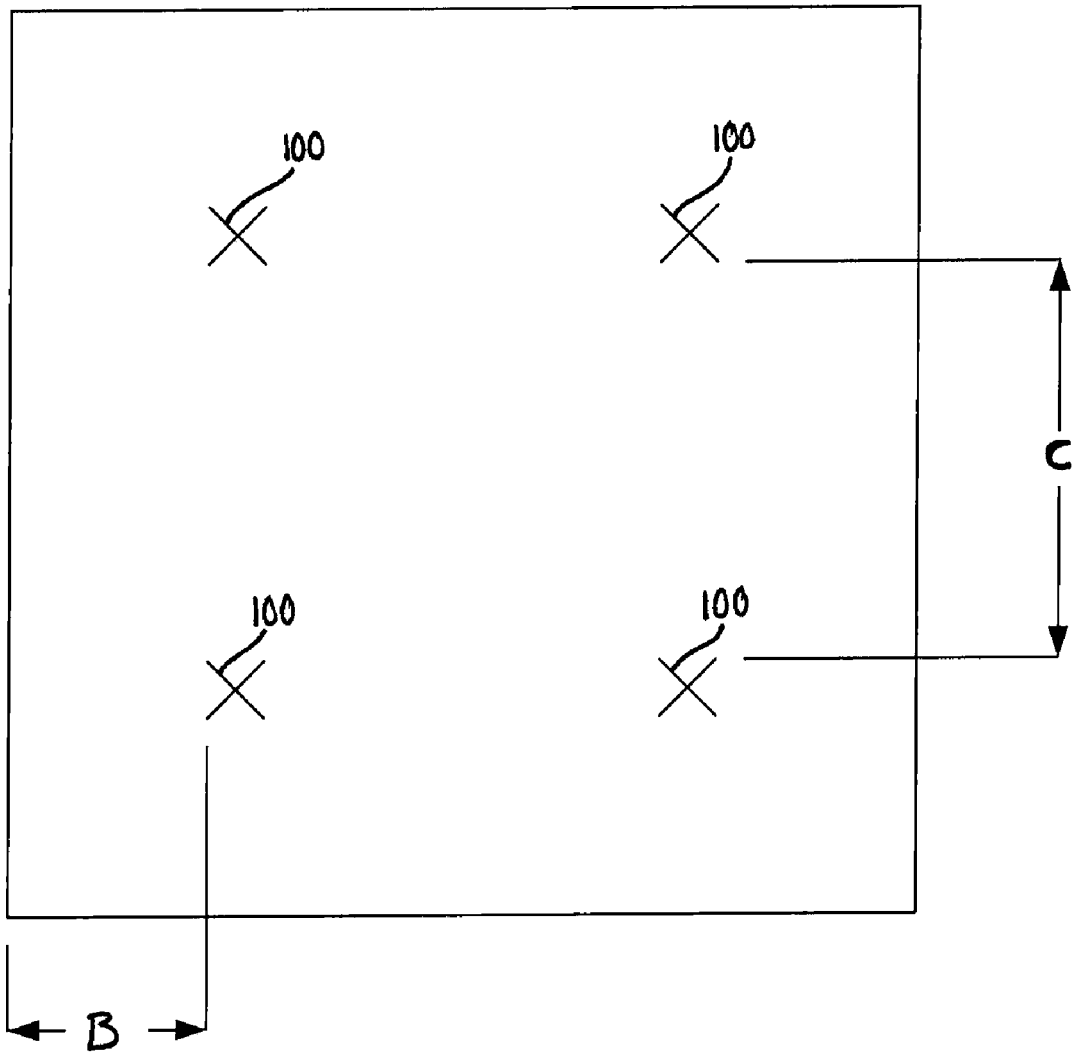
FIG. 16 is an example arrangement of lift points.

An example arrangement of lift points 100 is shown in FIG. 16. Each lift point 100 is at least a distance B from any side edge of the slab, and each lift point 100 is at least a distance C from any other lift point 100. The distance B is preferably between 12 inches to 18 inches, and the distance C is preferably between 10 feet to 12 feet. Those skilled in the art will appreciate that many different arrangements of lift points 100 may be used depending on the shape of the slab to be lifted.

Those skilled in the art will appreciate that a system is needed to control the motion of the screw jack assemblies 78. Any known system that provides such control may be used with the present system. For example, a system may be used such that the motion of multiple screw jack assemblies 78 is synchronized. Such a system may have position sensors at each lift point that input to a central controller that operates the different lift points to keep them all lifting at approximately the same position and equivalent rates.

Advantageously, this design is relatively inexpensive compared to other slab lift bracket designs. The invention incorporates consumables that can be made of inexpensive materials, such as the PVC tube 60 and the leaveout 62, and the metal consumables, i.e., the slab lift bracket, are relatively easy and inexpensive to manufacture. In addition, a slab lift bracket of the invention is capable of supporting significant loads. This is due to the length of the protruding members 36 and the arcuate sections 40 and 44. A further advantage is that the components embedded in the concrete slab after the lifting process can be completely concealed.

Having now described various aspects of the invention and preferred embodiments thereof, it will be recognized by those of ordinary skill that numerous modifications, variations, and substitutions may exist within the spirit and scope of the appended claims.

The invention claimed is:

1. A slab lift bracket, comprising:

an annular collar portion having an open center, a longitudinal axis at the center, an upper surface radially outward from the center, a lower surface, an outer surface that faces away from the center of the collar portion, and an inner surface that faces toward the center of the collar portion;

a plurality of elongated protruding members fixed to the collar portion, each protruding member extending from the collar portion away from the center of the collar portion in a radial plane relative to the collar and having at least a portion that extends below the lower surface of the collar portion to a free end, the protruding members being distributed around the collar portion and spaced angularly apart from each other;

wherein the upper surface of the collar portion includes holes having axes parallel to and radially outward from the central axis of the collar portion, said holes being adapted to receive rod members that would extend vertically into the holes and be fixed to the collar portion so as to suspend the anchor from said rod members;

wherein the protruding members extend outwardly perpendicularly from an upper portion of the outer surface of the collar portion where they are fixed to the collar portion and then downwardly at an angle from the collar so that in said outward and downward extension from the collar the protruding members together define a downwardly opening cone shape.

2. The slab lift bracket of claim 1, wherein the angle at which the protruding members extend downwardly is substantially 30° relative to a line that is perpendicular to the axis of the collar portion.

3. The slab lift bracket of claim 1, wherein each protruding member has an arcuate end section that terminates at a free end.

4. The slab lift bracket of claim 3, wherein each arcuate end section is hook shaped.

5. The slab lift bracket of claim 4, wherein each arcuate end section is semi-circular.

6. The slab lift bracket of claim 1, wherein each protruding member appears to be linear when projected on a plane perpendicular to the longitudinal axis of the collar portion.

7. The slab lift bracket of claim 1, wherein the holes in the upper surface of the collar portion are threaded to threadably attach said rod members.

8. The slab lift bracket of claim 1, wherein the protruding members are welded to the collar portion.

9. A method of forming a slab lift bracket, comprising the steps of:

forming a collar portion having an open center, an upper surface, a lower surface, an outer surface that faces away from the center of the collar portion, and an inner surface that faces toward the center of the collar portion;

fixing a plurality of straight members to the collar portion such that the straight members are substantially spaced apart from each other and distributed around the collar portion; and thereafter bending the plurality of straight members to form a plurality of protruding members such that each protruding member extends below the bottom surface of the collar portion to a free end, the protruding members extending out perpendicularly from an upper portion of the outer surface of the collar portion and then downwardly at an angle so as to define a downwardly opening cone shape.

10. The method of claim 9, wherein the plurality of straight members are bent simultaneously.

11. The method of claim 9, further comprising the step of forming holes in the upper surface of the collar portion that are positioned with axes of the holes radially outward from the center of the collar to threadably attach rod members.

12. The method of claim 9, wherein the collar portion is formed from seamless tube.

13. The method of claim 9, wherein the plurality of protruding members are formed from rod stock.

14. The method of claim 9, wherein the plurality of protruding members are fixed to the collar portion by welding.

15. The method of claim 9, wherein the plurality of protruding members are threadably fixed to the collar portion.

16. A slab lift bracket for lifting and holding a lowermost slab of a building a distance above a ground surface, comprising:

an annular collar portion having an open center, a longitudinal axis at the center, an upper surface radially outward from the center, a lower surface, an outer surface that faces away from the center of the collar portion, and an inner surface that faces toward the center of the collar portion;

a plurality of protruding members fixed to the collar portion, each protruding member extending from the collar portion away from the center of the collar portion and having at least a portion that extends below the lower surface of the collar portion, the protruding members being distributed around the collar portion so as to extend radially from a center of the collar portion and spaced apart from each other;

wherein the protruding members extend out perpendicularly from an upper portion of the outer surface of the collar portion and then downwardly at an angle so as to together define a downwardly opening cone shape.

* * * * *